US005467829A

United States Patent [19]

Barton et al.

[11] Patent Number: 5,467,829

[45] Date of Patent: Nov. 21, 1995

[54] AUTOMATIC LIFT AND TIP COORDINATION CONTROL SYSTEM AND METHOD OF USING SAME

[75] Inventors: James C. Barton, Peoria; Kevin J. Lueschow, Edwards; Ken L. Stratton, Dunlap, all of Ill.

[73] Assignee: Caterpillar Inc., Peoria, Ill.

[21] Appl. No.: 159,275

[22] Filed: Nov. 30, 1993

[51] Int. Cl.[6] ..... E02F 3/76; G06F 15/50

[52] U.S. Cl. ..... 172/4.5; 172/826; 364/424.07

[58] Field of Search ..... 172/2, 3, 4, 4.5, 172/7, 11, 12, 40, 699, 812, 826; 364/424.07, 431.07; 404/133.05, 117

[56] References Cited

U.S. PATENT DOCUMENTS 4,166,506 9/1979 Tezuka et al. ..... 172/812 X
4,282,933 8/1981 Suganami et al. ..... 172/4.5
4,352,398 10/1982 Schantz ..... 172/812
4,505,339 3/1985 Kramer et al. ..... 172/812
4,715,012 12/1987 Mueller, Jr. ..... 364/424 X
4,934,463 6/1990 Ishida et al. ..... 172/812 X
5,214,916 6/1993 Lukich ..... 60/431
5,293,944 3/1994 Matsumoto ..... 172/2
5,297,649 3/1994 Yamamoto et al. ..... 172/3 X

*Primary Examiner*—Dennis L. Taylor
*Assistant Examiner*—Robert Pezzuto
*Attorney, Agent, or Firm*—R. Carl Wilbur

[57] ABSTRACT

An automatic lift and tip coordination system for use in connection with an off-highway vehicle having an implement causes an automatic adjustment to the implement lift actuators in response to an operator change in the implement tip angle so that the implement height remains constant.

18 Claims, 5 Drawing Sheets

AUTOMATIC LIFT AND TIP COORDINATION CONTROL SYSTEM AND METHOD OF USING SAME

TECHNICAL FIELD OF THE INVENTION

The present invention generally relates to off-highway vehicles that have an implement capable of moving soil or objects. More specifically, the invention relates to a mechanism and method for automatically coordinating lift and tip functions of the vehicle implement so that the implement height remains constant even though the operator has changed the implement tip angle.

BACKGROUND OF THE INVENTION

Off-highway vehicles such as wheel loaders, bulldozers, and track loaders, for example, have a bucket or other implement to move soil or other objects. The following description of the drawbacks and disadvantages of known vehicles is described herein with reference to a bulldozer. However, those drawbacks apply to other similar vehicles having an implement.

A bulldozer operator typically has two controls that vary the orientation of the bulldozer blade: a tip control and a lift control. The tip control regulates the angle of the blade in relation to the ground. The lift control regulates the blade height, where blade height is a measure of the distance of the cutting edge from the ground. These two controls are not completely independent. For example, decreasing the blade angle will generally increase the height of the cutting edge. Thus, if the cutting edge initially rests on the ground, decreasing the blade angle will raise the cutting edge off the ground. It can be appreciated that having the cutting edge up off the ground during certain operations could severely affect productivity, The bulldozer operator can manually compensate for the change in blade height by using the lift controls, but it requires skill and diligence because the manual corrections require fine adjustments which are tedious and difficult to perform while managing the other operator tasks associated with bulldozing.

The present invention is directed toward overcoming one or more of these drawbacks.

SUMMARY OF THE INVENTION

In one aspect of a preferred embodiment of the present invention, a control device used on a bulldozer is disclosed. The control system includes a lift actuator and a tip actuator, and a command means for issuing a tip command signal corresponding to a desired blade position. An engine speed sensor produces an engine speed signal which is received by control means. The control means is adapted to also receive the tip command signal, and calculate a change in blade height in response to the tip command signal, calculate a change in lift position of the blade to compensate for the blade height change, and issue a control signal to the lift actuator.

In yet another aspect of a preferred embodiment, a method for controlling a bulldozer blade having a tip mechanism and a lift mechanism is disclosed, the method comprising the steps of: selecting a desired blade angle position; calculating a change in cutting edge displacement between the cutting edge displacement at a desired blade angle position and a previous blade angle position; issuing a command signal to a lift mechanism, the command signal corresponding to the change in cutting edge displacement; and moving the lift mechanism an amount equal to the change in cutting edge displacement.

The foregoing and other aspects of the present invention will become apparent from reading the detailed description of the invention in conjunction with the appended drawings and claims.

DETAILED DESCRIPTION OF THE INVENTION

The present invention may be used in connection with any off-highway vehicle having an implement that moves soil or other objects. For example, the invention might be used in connection with a wheel loader, a track loader, a bulldozer or other similar vehicles having an implement. While the following detailed description of a preferred embodiment describes the invention in connection with a bulldozer, it should be recognized that the description applies equally to the use of the invention on other such vehicles. The present invention is not limited to use on a bulldozer. To the contrary, the present invention as defined by the claims encompasses other similar off-highway vehicles having an implement.

Figure 1:
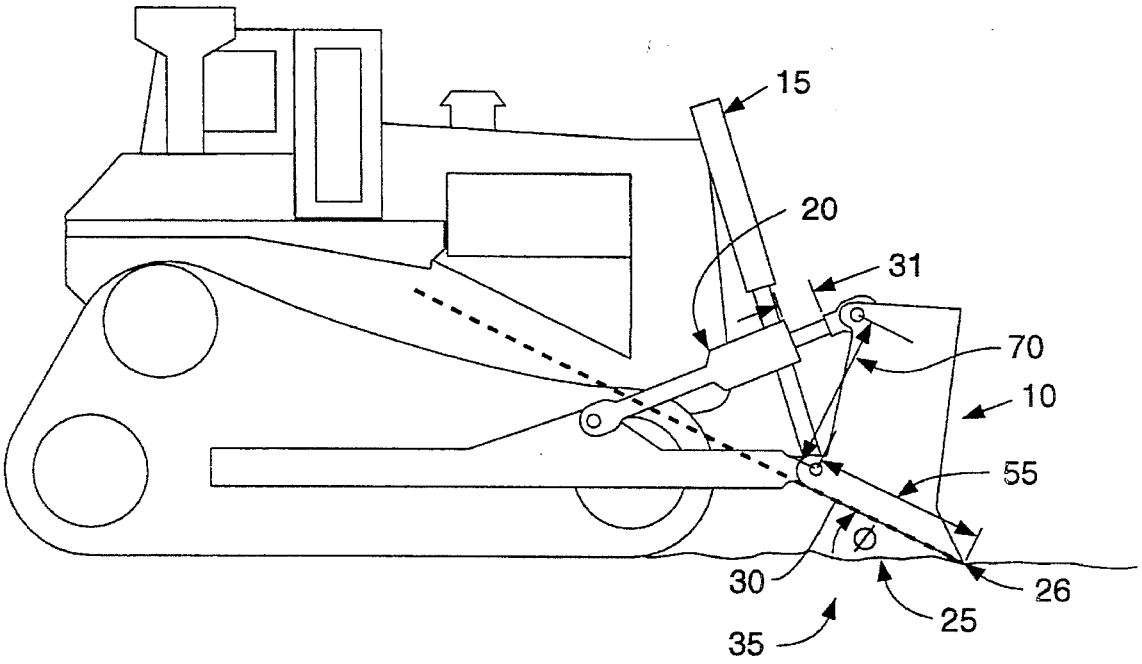
FIG. 1 is a side-view of a bulldozer equipped with the automatic lift and tip coordination control of the present application.

Referring to FIG. 1, a side view of a bulldozer incorporating the present invention is shown. The bulldozer blade 10 is controlled through the movement and positioning of the lift cylinders 15 and the tilt cylinders 20. Although not shown in FIG. 1, the bulldozer preferably includes two lift cylinders 15 and two tilt cylinders 20, one on each side of the bulldozer blade 10.

The blade angle 25 is a measure of the angle between a plane substantially formed by the bottom portion 30 of the bulldozer blade 10 and a plane substantially formed by the ground 35. The operator can adjust the position of the tilt cylinders 20 which will change the blade angle 25. Likewise, the operator can adjust the position of the lift cylinders 15 can be moved to adjust the cutting edge height 27, measured as the distance between the cutting edge 26 and the ground 35.

Typically, a bulldozer is operated sequentially through three different modes. These modes include a load mode, a spread mode and a carry mode. During the load mode the operator cuts or scrapes the ground with the cutting edge to loosen soil. During the carry mode the loosened soil is pushed or carried to a second location, and during the spread mode the soil is dumped or spread in the second location. Each of these three operational modes has a different optimum blade angle 15.

Figure 2:
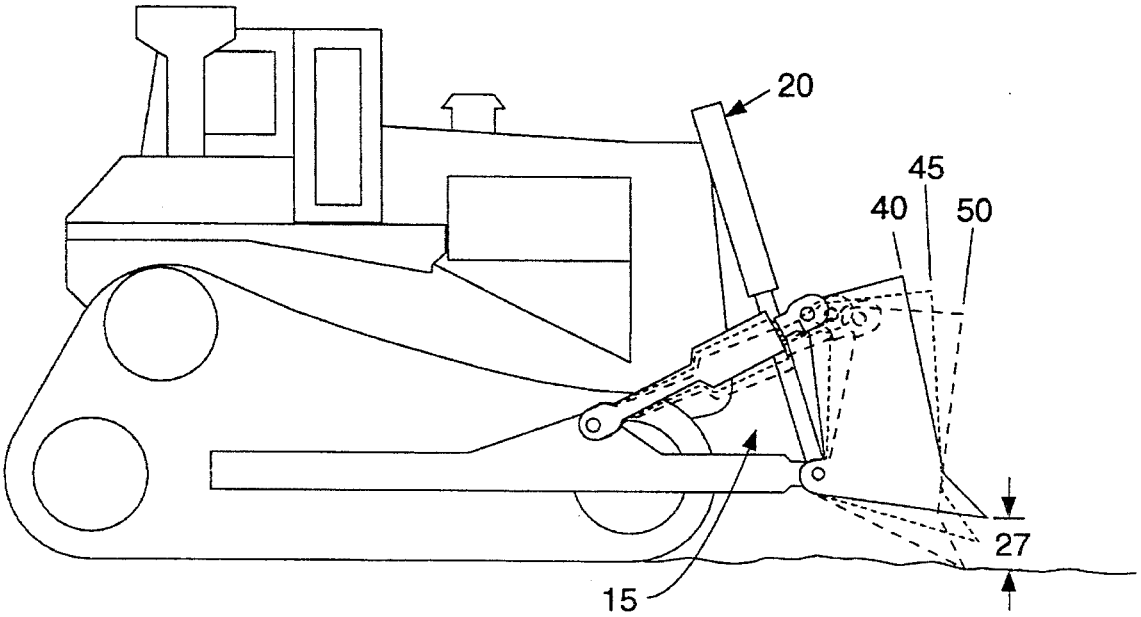
FIG. 2 is a side view of the bulldozer blade.

FIG. 2 illustrates the general relationship between typical optimum blade angles for the carry mode 40, the load mode 45, and the spread mode 50. The optimum blade angle 25 for the carry mode 40 is the smallest, while the optimum angle for the spread mode 50 is the largest. The optimum blade angle for the load mode 45 is intermediate those two angles.

Typically, the bulldozer operator will sequence through each of these modes relatively quickly. Thus, the operator will load for a short time until enough soil has been scraped from the work area. Then the operator will carry the soil to a second area and spread the soil. The operator will then return to the load area and repeat the entire sequence. To operate most efficiently, the operator must change the blade angle to the optimum blade angle for each specific operational mode. However, as noted above, changing the blade angle will also affect the blade height and may cause the cutting edge to come up off the ground. The operator must therefore simultaneously attempt to manipulate the lift control to keep the cutting edge height 27 constant. However, because the demands on the operator are great when sequencing through the modes, the operator generally cannot keep the blade at a constant height. However, this can severely affect productivity. For example, when the operator decreases the blade angle when moving from loading mode to carrying mode the cutting edge will lift off of the ground. If the operator fails to adjust the lift cylinders 15, the load may fall out of the blade 10 without being carried to the second location.

Figure 3:
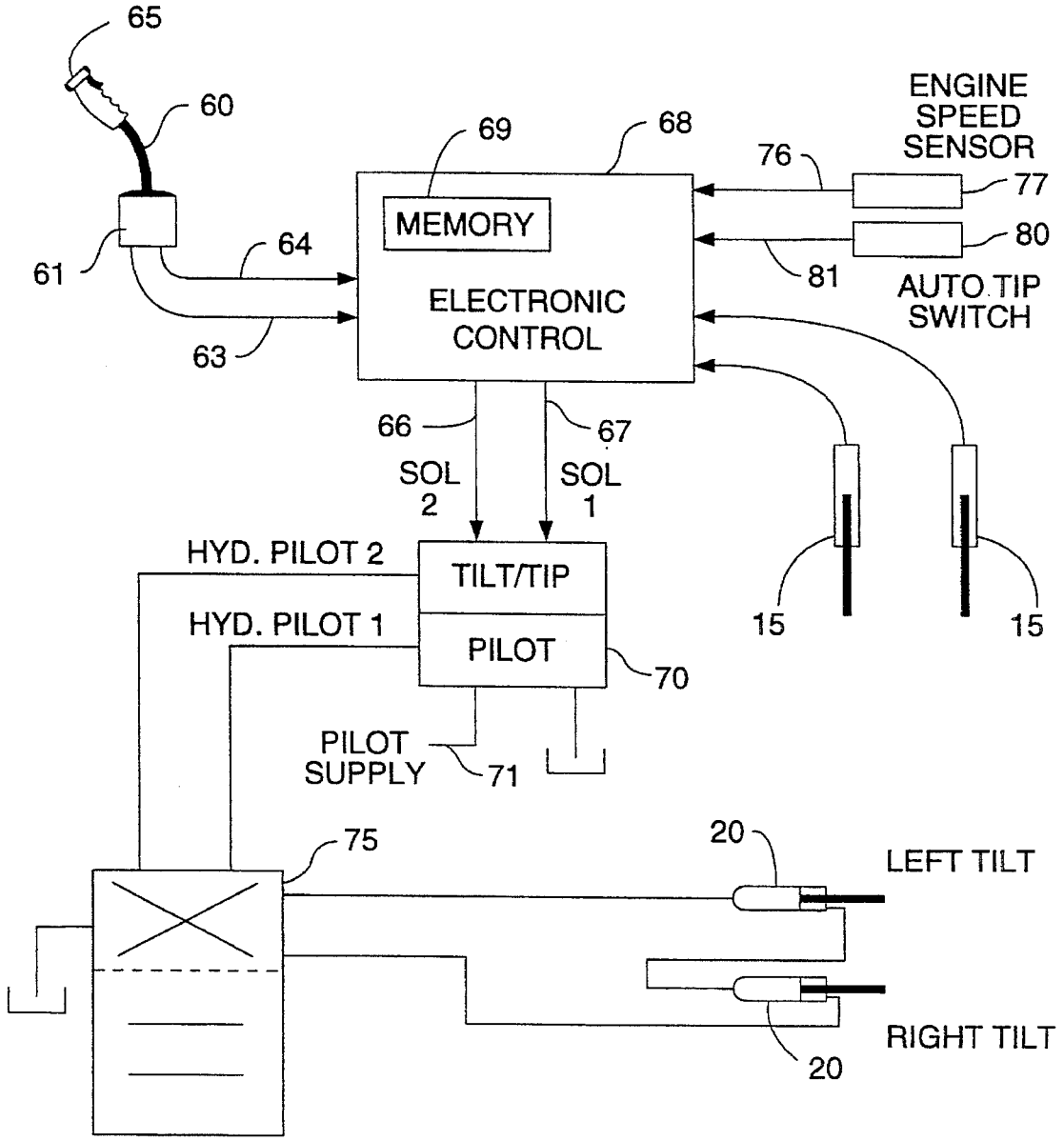
FIG. 3 is a block diagram of the control circuit of the automatic lift and tip control.

FIG. 3 shows a block diagram of the components of the automatic lift and tip coordination control system of a preferred embodiment. The operator controls the blade by using the control handle 60. On the top of the handle is a three position thumb switch 65 that allows the operator to select one of the three operational modes: load, carry or spread. To increase the blade angle 25 the operator moves the handle 60 to the right. To decrease the blade angle 25 the operator moves the handle 60 to the left. When no force is exerted on the handle 60, it remains in an intermediate position between left and right stops.

Sensors are located in the handle base 61 to produce left and right signals 63, 64 that are a function of the position of the handle 60. The left and right signals 63, 64 are connected to the electronic control 68. The electronic control 68 calculates solenoid driver signals 66, 67 to cause the proportional pilot valve 70 to transmit a flow of hydraulic fluid from the pilot supply 71 to the tilt actuator valve 75. The proportional pilot valve 70 thereby controls the position of the tilt actuator valve 75 which controls the amount and direction of high pressure fluid flowing to the tilt cylinders 20. In this manner, by manipulating the control handle 60, the operator can control the fluid flow to the tilt cylinders 20, and can adjust the blade angle 25.

As can be appreciated, by knowing the geometric relationship of the bulldozer components and the position of the tilt cylinders 20 and lift cylinders 15, the electronic control 68 can calculate the blade angle 25. There are several known linear position sensing devices that measure absolute position and could be used in connection with the cylinders. For example, RF (Radio Frequency) sensors or LVDT (Liner Variable Differential Transformer) sensors are both well known position sensors. However, those devices are expensive and greatly increase the cost of the control. Instead, in a preferred embodiment of the present invention, a relative position is calculated as a function of the amount of hydraulic fluid entering a cylinder, which is a function of the flow rate of hydraulic fluid and the time over which fluid enters the cylinder. In a preferred embodiment, the electronic control calculates the tilt cylinder position according to EQN 1:

$$\text{tilt_cylinder_position} = \text{initial_position} + K \text{ flow } dt \quad (1)$$

where

K=1/(cross sectional area of the cylinder); and t=on time of the hydraulic cylinder.

Because EQN 1 calculates a relative position, as shown in the equation, it is necessary to first establish a known initial position.

The electronic control 68 calculates the position of the tilt cylinders 20 by first "zeroing" the tilt cylinders. That is, the electronic control 68 causes the tilt cylinders 20 to move to a known position, then stores the value corresponding to that known position in the memory 69. The zeroing procedure is preferably accomplished by the electronic control 68 issuing solenoid driver signals 66, 67 that cause the tilt actuator valve 75 to cause the tilt cylinders 20 to retract. The driver signals 66, 67 are applied for a sufficient length of time to ensure that the tilt cylinders 20 retract against a mechanical stop (not shown in the figures). The electronic control 68 stores a position value in memory 69 corresponding to the tilt cylinders 20 being fully retracted against their stops. Then, as shown in EQN 1, the position of the tilt cylinders 20 can be determined by calculating relative movement of the cylinder with respect to that known position. The electronic control 68 calculates a new position relative to the known position by measuring the flow rate of the hydraulic fluid and the length of time the fluid is allowed to enter or leave the cylinder at that rate.

The flow rate of the fluid could be calculated by placing a flow meter 8 on the conduits to the tilt cylinders 20. However, in the present invention the flow meter has been eliminated, and flow rate is instead approximated as a function of engine speed. Experimentation has shown that flow rate can be closely approximated as a function of the engine speed so long as there is only a single demand on the hydraulic system. Thus, in a preferred embodiment, the electronic control 68 of the present invention calculates the flow rate from the engine speed signal 76 of the engine speed sensor 77. The electronic control can precisely determine the tilt cylinder "on time" by the duration of the solenoid driver signals 66, 67 issued to the proportional pilot valve. From the "on time" and the engine speed signal 76, the electronic control unit can then calculate the position of the tilt cylinders 20.

Because tilt cylinder position is calculated by integrating fluid flow, a large integration error may develop over time. Thus, it is necessary to "zero" the tilt cylinders periodically by returning them to a known position and setting value stored in the electronic control to that known value. As noted above, in a preferred embodiment the tilt cylinders 20 are zeroed by fully retracting them against mechanical stops and setting the tilt position value in memory 69 to zero.

In a preferred embodiment, the electronic control 68 also calculates a relative position of the lift cylinders 15 in a similar manner as described with respect to the tilt cylinders. By knowing the position of both the lift cylinders 15 and the tilt cylinders 20, the electronic control can calculate the cutting edge height 27. Then, when the operator commands a change in the blade angle 25, the electronic control 28 can calculate the necessary adjustment to the lift cylinders 15 to keep the cutting edge height 27 the same as before the change in the blade angle.

Figure 4A:
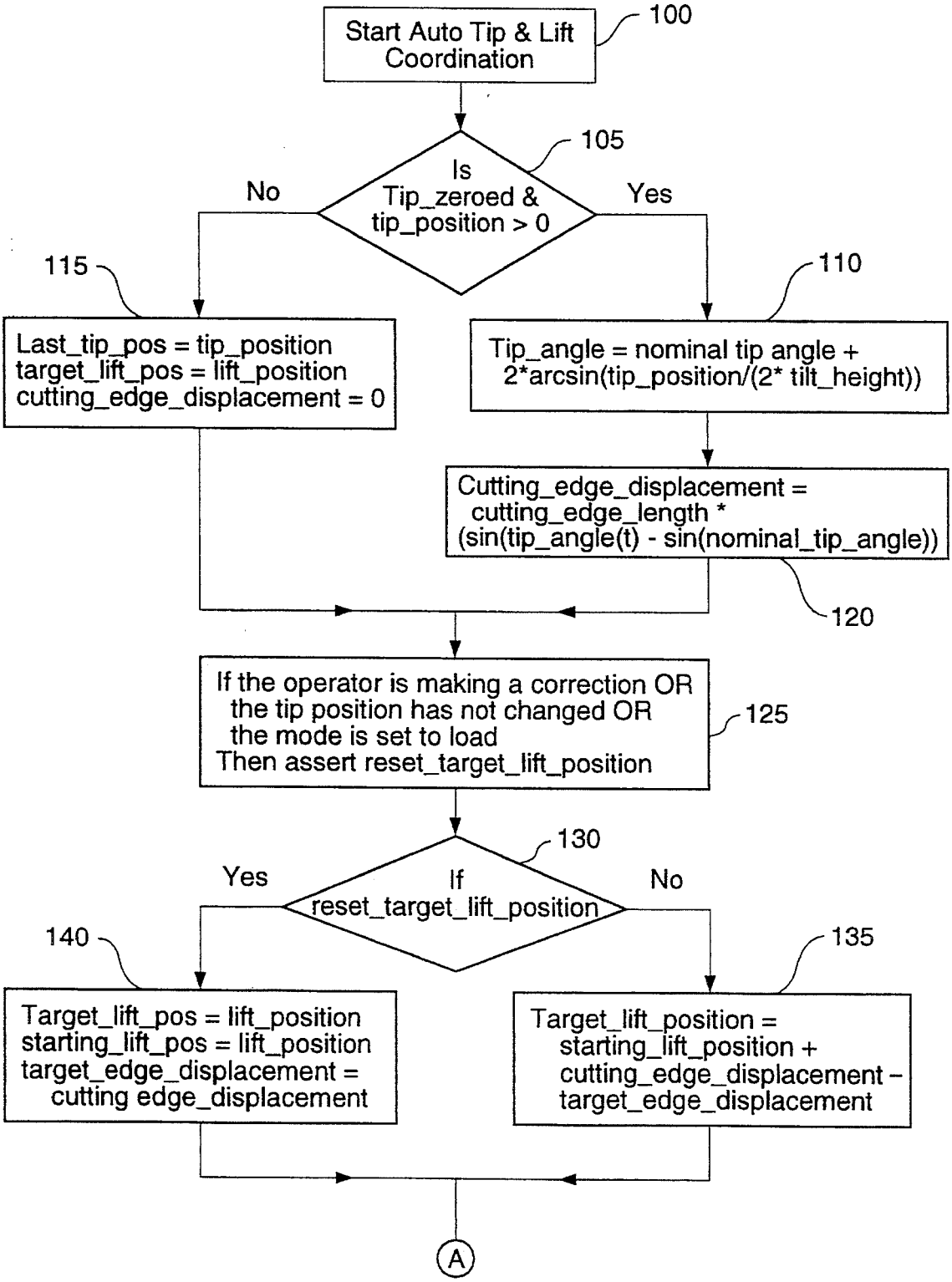
FIG. 4 is a flow chart generally showing the software control of the present invention.

FIG. 4 shows a flow chart of the software implementation of the control strategy of the automatic lift and tip coordination control of the present application. The flowchart depicts a full and complete set of instructions for creating the necessary software for use with any suitable microprocessor. Writing the software instructions from the flowchart would be a mechanical step for one skilled in the art of writing such software.

The operator first starts the bulldozer engine and engages the automatic lift and tip coordination feature by pressing the auto tip switch 80 shown in the block diagram of FIG. 3. The electronic control 68 initially does not have a position value stored in memory 69 for the position of the tilt cylinders 20. It is therefore necessary to "zero" the blade by moving it to a known position. As described above, the control device accomplishes this by first fully retracting the tilt cylinders 20 for a sufficient length of time to insure that the tilt cylinders will be retracted against the mechanical stops and storing a value in memory 69 that corresponds to the fully retracted position.

Thereafter, when the operator engages the automatic lift and tip coordination feature by pressing the auto tip switch 80, the control system proceeds through the control strategy shown in FIG. 4 to automatically adjust the height of the blade. Each of the variables shown in FIG. 4 is listed and described below in Table 1.

TABLE 1

Definition of the terms used in the flow chart.

| | Control Variables |
|---|---|
| Tip_angle: | The angle between a plane formed substantially by the bottom of the blade and a plane formed by the ground. |
| Tip_position: | A measured or calculated indication of the average tilt cylinder extension. |
| Nominal_lift_extension: | The average lift cylinder extension when the tilt cylinders are fully retracted. |
| Lift_position: | The difference between the nominal_lift_extension and the average extension of the lift cylinders. |
| Tilt_height: | The distance between the center of the pivot pin which attached the bulldozer blade to the tilt cylinder and the center of the pin that attached the bulldozer blade to the tilt arm. |
| Nominal_tip_angle: angle: | The tip angle when both tilt cylinders are fully retracted. |
| Cutting_edge_ height: | The distance between the cutting edge and the ground along a line perpendicular to a plane tangent to the ground slope. |
| Target_edge_ displacement | The cutting edge displacement position command, i.e., the position to which the cutting edge is to move. |

Referring to FIG. 4, a flowchart of the software control implemented in the electronic control 68 of a preferred embodiment is shown. Upon engaging the automatic lift and tip coordination feature by depressing the automatic tip switch 80, the electronic control 68 begins software control at block 100. Control then passes to block 105 where the electronic control determines whether the tilt cylinders have been zeroed (Tip_zeroed) and the present tip_position stored in the memory 69 of the electronic control 68 is greater than zero. It is necessary to ensure that the stored position is greater than zero because, as noted above, integration errors in the position calculation of EQN 1 may cause the calculated relative tilt cylinder positions to be a negative value. If the tilt cylinders 20 have not been zeroed then the Tip_zeroed flag will not be set and control passes to block 115. Likewise, if errors have caused the stored tip_position value to be negative then control passes to block 115. In block 115, the last_tip_position is set to the current tip_position, the target_lift_position is set to the current lift_position, and the cutting edge displacement is set to zero. If the Tip_zeroed flag is set and the tip_position is greater than zero, control passes from block 105 to block 110.

In block 110, the electronic control 68 calculates the current tip_angle 25. As shown, the tip_angle 25 is a function of the nominal_tip_angle (the tip angle when the tilt cylinders 20 are fully retracted), the current tip_position 31, and the tilt_height 21. The specific equation shown in block 110 is a function of the specific geometric relationship between the tip function, the lift functions and other components of a CATERPILLAR BULLDOZER MODEL NO. D10N. The equation shown in block 110 can be easily modified by one skilled in the art to embody the specific geometric relationship between the tip and lift functions of any specific bulldozer. Control then passes to block 120 where the electronic control 68 calculates the current cutting_edge_displacement 31, which is a function of the cutting_edge_length 55, the current tip_angle 25 and the nominal_tip_angle, From either of blocks 115 or 120, control passes to block 125, where the electronic control determines whether it must reset the target_lift_position, and if so, then sets the reset_target_lift_position flag. As shown in block 125, the reset_target_lift_position flag is reset when the operator has made a correction to the Tip_angle or the tip_position has not changed or the operator has selected the load mode on the thumb switch 65. The target_lift_position is the position at which the lift cylinders 15 must be to maintain a certain cutting_edge_displacement 27 given a change in the tip_angle 25.

If the operator is in the process of making a manual correction to the lift cylinders 20 to change the tip_angle 25 of the blade, or there has been no change to the tip_angle (measured by a change in the current tip_position versus the last_tip_position), or the bulldozer is operating in the load mode, then the target_lift_position needs to be reset to a new target_lift_position. Thus, the electronic control 68 asserts the reset_target_lift position flag. In that case, control passes from block 130 to block 140. In block 140 the target_lift_position and the starting_lift_position are both set to the current lift_position and the target_edge_displacement is set to the cutting_edge_displacement. Since the target_lift_position was set to the current lift_position, the electronic control 68 does not generate a solenoid driver signal 66, 67 to actuate the lift cylinders 15.

If, on the other hand, the reset_target_lift_position was not set, then an automatic adjustment is required by the lift cylinders 15 to keep the cutting_edge displacement at a constant height and control passes from block 130 to block 135. In block 135, the electronic control 68 calculates a new target_lift_position as a function of the starting_lift_position, the cutting_edge_displacement 27, and the target_edge_displacement as shown by the equation in block 135.

Figure 4B:
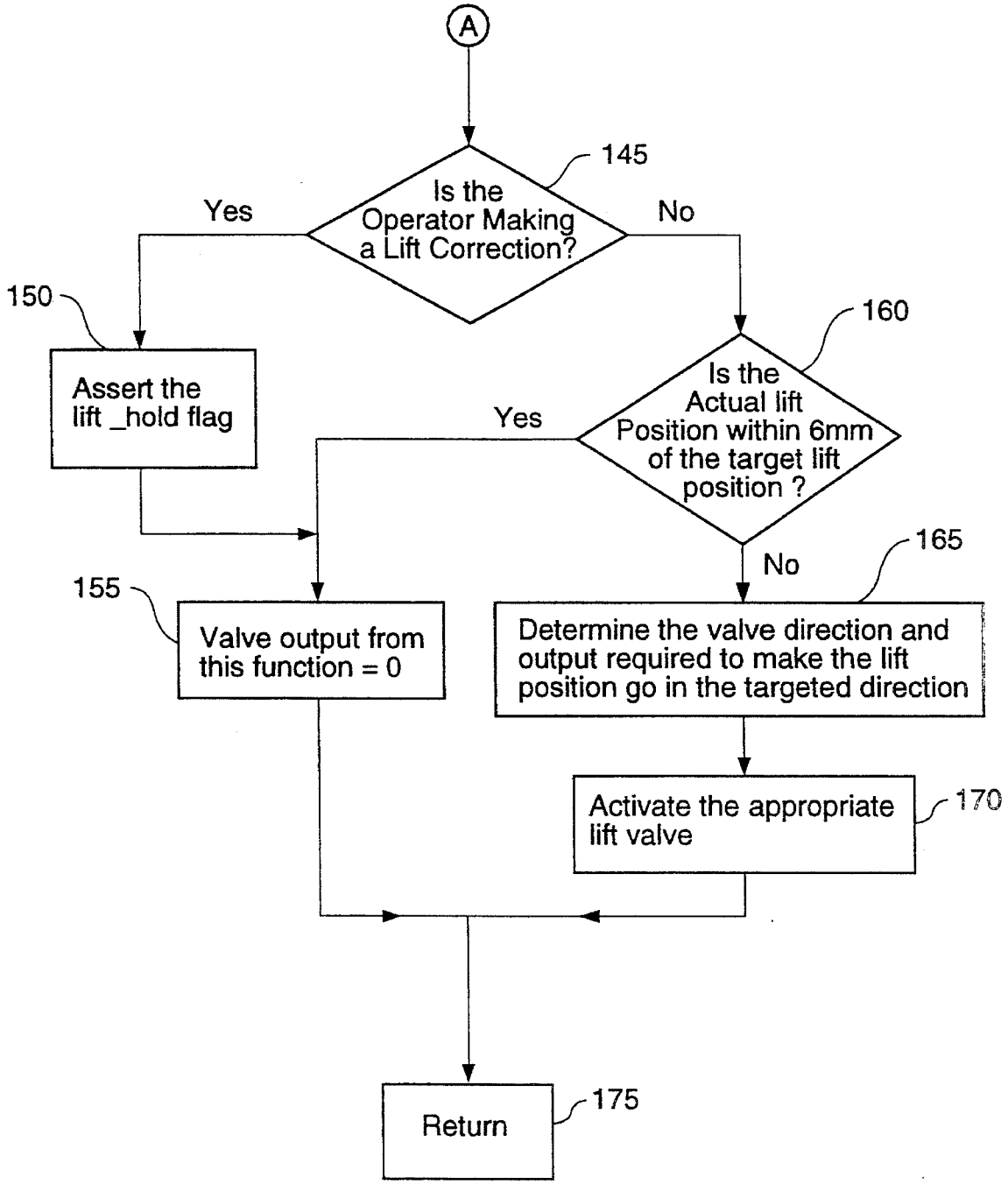

Referring to FIG. 4*b*, in decisional block 145 the electronic control 68 senses the fore and aft signals 63, 64 to determine whether the operator is making an adjustment to the lift cylinders 15 of the blade 10. If the operator is making an adjustment then in block 150 the electronic control 68 sets the Lift_hold flag. Control then passes to block 155 where the electronic control 68 prevents automatic adjustment of the lift cylinders 15 until after the operator is finished making the lift correction by holding the valve output from this function equal to zero. Thus, no automatic lift command is issued by the electronic control 68.

If the operator is not making a correction to the lift cylinders 15, then control passes to block 160. If the lift_position is within six millimeters of the target_lift_position, then control passes to block 155 where the electronic control 68 sets the solenoid driver signals 66, 67 to the proportional pilot valve 70 to zero, thus stopping further movement of the lift cylinders 15. Although in the present embodiment of the invention the tolerance is set to six millimeters, it can be appreciated that another tolerance could be readily implemented without deviating from the spirit of the present invention. In block 160, if the lift_position is more than six millimeters from the target_lift_position then control passes to block 165 where the electronic control 68 calculates the solenoid driver signals 66, 67 necessary to cause the lift cylinders 15 to move to the target_lift_position, and issues the calculated solenoid driver signals 66, 67 to the proportional pilot valve 70 which causes the lift cylinders to move to within six millimeters of the target_lift_position. In block 175, the auto lift and tip correlation control system then returns to block 100 to begin another control sequence.

Industrial Applicability

It can be appreciated that by using the present invention on a bulldozer the operator can maintain a constant blade height without having to manually adjust the lift cylinders. Because the operator sequences through several different operating modes, each having a different optimum angle, the operator must repeatedly adjust the lift cylinders to maintain a constant blade height. The present invention will increase productivity and make the operator's job less tiring by automatically maintaining a constant blade height throughout the sequence of operational modes, unless the operator manually adjusts the lift height.

We claim:

1. A control device used on an off-highway vehicle, comprising:

an implement;

a lift actuator associated with the implement;

a tilt actuator associated with the implement;

a command means for issuing a tip command signal corresponding to a desired implement tip angle position;

an engine speed sensor having an engine speed signal; and control means for receiving the engine speed sensor signal and the tip command signal, calculating a change in implement height in response to the tip command signal, calculating lift actuator command signal to compensate for the blade height change, and issuing the lift actuator command signal to the lift actuator.

2. A control device according to claim 1 wherein the lift actuator and tilt actuator include a hydraulic lift cylinder and a hydraulic tilt cylinder respectively.

3. A control device for use with an off-highway vehicle, comprising:

an implement;

a lift actuator associated with the implement;

a tilt actuator associated with the implement;

an adjustment means for manually adjusting the implement tip angle;

a position sensor connected to said manual adjustment means, said position sensor producing a manual adjustment signal;

a tip position sensing means associated with the tilt actuator for sensing the position of the tilt actuator and outputting a tip position signal corresponding to said position;

a lift position sensing means associated with the lift actuator for sensing the position of the lift actuator and outputting a lift position signal corresponding to said position; and control means for receiving the tip position signal, receiving the lift position signal, receiving the manual adjustment signal, calculating a change in implement height in response to a control command signal, and automatically issuing a lift actuator command signal.

4. A control device according to claim 3 wherein the lift actuator and tilt actuator include a hydraulic lift cylinder and a hydraulic tilt cylinder respectively.

5. A control device according to claim 3 wherein the tip position sensing means includes:

an engine speed sensor having an engine speed signal;

a timing means for determining the length of time said tilt actuator is activated, said timing means adapted to produce a tilt time activated signal; and wherein said control means receives said engine speed signal, said tilt time activated signal, said valve open signal, and calculates the tip position signal.

6. A control device according to claim 3 wherein the tip position sensing means comprises an RF sensor.

7. A control device according to claim 3 wherein the tip position sensing means comprises an LVDT sensor.

8. A control device according to claim 3 wherein the lift position sensing means comprises an RF sensor.

9. A control device according to claim 3 wherein the lift position sensing means comprises an LVDT sensor.

10. On an off-highway vehicle, a control device, comprising:

an implement;

a tilt cylinder connected to the implement;

a lift cylinder connected to the implement;

a first position sensor associated with the tilt cylinder;

a second position sensor associated with the lift cylinder;

a manual adjustment handle;

a third position sensor associated with the manual adjustment handle;

an electronic control adapted to receive a signal from the first, second and third position sensors, and responsively produce a lift command signal;

a pressurized supply of hydraulic fluid;

a tilt cylinder actuator valve hydraulically connected to the pressurized supply and the tilt cylinder;

a lift cylinder actuator valve hydraulically connected to the pressurized supply and the lift cylinder, the lift cylinder actuator valve controlling the flow of hydraulic fluid from the pressurized supply to the lift cylinder responsive to the lift command signal.

11. A control device according to claim 10, wherein the first position sensor includes an engine speed sensor and timing means for determining an on time of the tilt cylinder.

12. A control device according to claim 10, wherein the second position sensor includes an engine speed sensor and timing means for determining an on time of the tilt cylinder.

13. A control device according to claim 10, including:

memory means for storing a first position sensor signal corresponding to the approximate implement tip angle;

wherein said stored first position signal is updated upon a change in said first position sensor signal;

wherein said electronic control calculates a change in the height of the implement corresponding to the change in the first position sensor signal and responsively produces a lift command signal as a function of said change in height.

14. A method for controlling a off-highway vehicle having a tip mechanism and a lift mechanism associated with an implement, comprising the steps of:

selecting a first implement tip angle position;

sensing the position of the tip mechanism at said first selected implement tip angle position;

selecting a second implement tip angle position;

sensing the position of the tip mechanism at said second selected implement tip angle position;

calculating a change in implement height corresponding to the change in sensed implement tip angle position from said first implement tip angle position to said second implement tip angle position;

issuing a command signal to the lift mechanism; and moving the lift mechanism an amount corresponding to the command signal.

15. The method according to claim 14, wherein said command signal is a function of the change in implement height.

16. The method according to claim 14, including the step of causing the tip mechanism to fully retract prior to selecting a first implement tip angle position.

17. The method according to claim 16, wherein said sensing steps include the steps of:

sensing an engine speed;

calculating flow rate of hydraulic fluid from said sensed engine speed;

measuring the length of time a tip mechanism is actuated;

and calculating the position of the tip mechanism from said flow rate and said actuation time.

18. The method according to claim 14, including the steps of:

sensing the position of said lift mechanism;

determining whether said lift mechanism is within a predetermined tolerance of the lift position corresponding to the command signal;

issuing a second command signal in response to said lift mechanism position being greater than the predetermined tolerance from said lift position corresponding to the command signal.

* * * * *